US008114487B2

(12) United States Patent
Schultz et al.

(10) Patent No.: US 8,114,487 B2
(45) Date of Patent: Feb. 14, 2012

(54) INKJET RECORDING MEDIA WITH CATIONICALLY-MODIFIED CLAY PARTICLES

(75) Inventors: Terry C. Schultz, Hilton, NY (US); Bruce C. Campbell, Webster, NY (US); Andrew M. Howe, Cambridge (GB); Kenneth J. Ruschak, Rochester, NY (US); Robin D. Wesley, Wokingham (GB)

(73) Assignee: Eastman Kodak Company, Rochester, NY (US)

( * ) Notice: Subject to any disclaimer, the term of this patent is extended or adjusted under 35 U.S.C. 154(b) by 867 days.

(21) Appl. No.: 12/183,658

(22) Filed: Jul. 31, 2008

(65) Prior Publication Data

US 2010/0026773 A1 Feb. 4, 2010

(51) Int. Cl.
*B41M 5/00* (2006.01)

(52) U.S. Cl. ..... 428/32.21; 428/32.24; 428/32.25; 428/32.28; 428/32.29; 428/32.3; 428/32.34; 428/32.35; 428/32.36

(58) Field of Classification Search ..... 428/32.21, 428/32.24, 32.25, 32.28, 32.29, 32.3, 32.34, 428/32.35, 32.36; 427/243
See application file for complete search history.

(56) References Cited

U.S. PATENT DOCUMENTS

| | | | | |
|---|---|---|---|---|
| 6,150,289 | A | 11/2000 | Chen et al. | |
| 6,630,212 | B2 | 10/2003 | Bermel et al. | |
| 2002/0136867 | A1 | 9/2002 | Bermel et al. | |
| 2005/0170108 | A1 * | 8/2005 | Darsillo et al. | 428/32.34 |
| 2007/0202279 | A1 | 8/2007 | Schultz et al. | |

FOREIGN PATENT DOCUMENTS

| | | |
|---|---|---|
| WO | WO 98/36029 | 8/1998 |

* cited by examiner

*Primary Examiner* — Betelhem Shewareged
(74) *Attorney, Agent, or Firm* — Arthur E. Kluegal; Andrew J. Anderson

(57) ABSTRACT

An inkjet printing system, comprises an inkjet printer, an ink composition, and an inkjet recording media comprising a support, and coated on the support in order from the support, a porous base layer, a porous intermediate layer, and a porous uppermost layer, each with particular limitations. The inkjet recording media and printer system is manufacturable using low-cost materials in an efficient process requiring only a single coating and drying step and that gives images with excellent gloss, color density and image quality.

20 Claims, 2 Drawing Sheets

INKJET RECORDING MEDIA WITH CATIONICALLY-MODIFIED CLAY PARTICLES

CROSS-REFERENCE TO RELATED APPLICATIONS

The present application is related to U.S. application Ser. No. 12/183,699, filed on Jul. 31, 2008 simultaneously herewith, and entitled, "INK JET RECORDING MEDIA WITH CATIONICALLY-MODIFIED CLAY PARTICLES."

FIELD OF THE INVENTION

The invention relates to a multilayer coated inkjet receiver suitable for high-quality inkjet printing, a method for its manufacture, and a method of printing on the paper with an inkjet printer. More specifically, the invention relates to an inkjet recording element with excellent printed color density, image quality, and gloss. The coating compositions are compatible with coating the layers in a single coating pass.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of an aqueous mixture, for example, comprising water and one or more organic materials such as a monohydric alcohol, or a polyhydric alcohol.

An inkjet recording element typically comprises a support having on at least one surface thereof at least one ink-receiving layer (IRL). There are generally two types of IRLs. The first type of IRL comprises a non-porous coating of a polymer with a high capacity for swelling, which non-porous coating absorbs ink by molecular diffusion. Cationic or anionic substances may be added to the coating to serve as a dye fixing agent or mordant for a cationic or anionic dye. Typically, the support is a smooth resin-coated paper and the coating is optically transparent and very smooth, leading to a very high gloss "photo-grade" inkjet recording element. However, this type of IRL usually tends to absorb the ink slowly and, consequently, the imaged receiver or print is not instantaneously dry to the touch.

The second type of ink-receiving layer or IRL comprises a porous coating of inorganic, polymeric, or organic-inorganic composite particles, a polymeric binder, and optional additives such as dye-fixing agents or mordants. These particles can vary in chemical composition, size, shape, and intra-particle porosity. In this case, the printing liquid is absorbed into the open interconnected pores of the IRL, substantially by capillary action, to obtain a print that is instantaneously dry to the touch. Typically the total interconnected inter-particle pore volume of porous media, which may include one or more layers, is more than sufficient to hold all the applied ink forming the image.

Basically, organic and/or inorganic particles in a porous layer form pores by the spacing between the particles. The binder is used to hold the particles together. However, to maintain a high pore volume, it is desirable that the amount of binder is limited. Too much binder would start to fill the pores between the particles or beads, which would reduce ink absorption. On the other hand, too little binder may be insufficient to prevent cracking of the porous layer.

A porous inkjet recording medium that is glossy usually contains at least two layers in addition to the support: a base layer nearer to the support, and a glossy image-receiving layer further from the support. One method of obtaining a "photographic-grade" gloss is to coat the inkjet receiving layers on a resin-coated paper support. Resin-coated paper support is relatively costly, however, and requires an extra resin-coating step in its manufacture.

For example, Bermel et al., U.S. Pat. No. 6,630,212, describes an inkjet recording medium comprising two porous layers coated on a resin-coated support paper. The two layers are coated simultaneously by a pre-metering method, extrusion hopper coating, on a polyethylene resin-coated support paper. The base-layer coating composition comprises filmed alumina particles, PVA binder, and coating aids at a solids content of 30%. The coated weight of the base layer is 43 g/m$^2$. An image-receiving layer over the base layer comprises fumed alumina particles, cationic polymeric latex dispersion, and poly(vinyl alcohol) (PVA) binder. The coated weight of the IRL is 2.2 g/m$^2$. Alumina is a relatively expensive material for recording materials of high ink capacity.

Inkjet recording media with "photographic-grade" gloss can also be made when coating on a plain paper support. Because plain paper supports are generally rougher or less smooth than resin-coated paper supports, however, it is typically necessary to use special coating processes, such as cast coating or film transfer coating in order to achieve a smooth, glossy surface on the image receiving layer. These specialized coating methods are constrained in their productivity by drying considerations or by extra steps. Mild calendering with heat and pressure may also be used in combination with conventional post-metered (blade, rod, or air-knife) or pre-metered (bead or curtain) coating processes on plain paper in order to produce a glossy surface on the image-receiving layer. Excessive calendering may result in a loss of ink absorbing capacity.

Manufacturing processes for porous inkjet receivers typically employ coating of aqueous particle dispersions. Particles useful in such compositions generally possess a surface charge that aids the stability of the dispersion by providing repulsive forces between particles and attractive forces with the polar molecules of the aqueous phase. These particles may be characterized according to the chemical nature of the surface. If the charged chemical moieties on the particle surface predominately possess a formal negative charge, the particle is herein defined as an anionic particle. Dispersions of calcium carbonate and silicon oxide particles in their natural state (at moderate pH range between 3 and 10) are examples of anionic particles. In contrast, dispersed particles with net positive surface charge are termed herein cationic particles. Alumina is an example of a cationic particle often used in porous layers of inkjet receivers.

Inkjet receivers with porous layers employing the aforementioned particles are known. Schultz, et al., in US Patent Publication No. 2007/0202279, describe a porous three-layer ink-receiving material coated on plain paper support. The porous base layer comprises anionic pigments, for example, precipitated calcium carbonate (PCC) and silica gel, and binders, for example, poly(vinyl alcohol) and styrene-butadiene latex, and a total dry weight of at least 25 g/m$^2$. One of the main functions of the base layer in a three-layer material is to provide a smoother substrate than a raw paper upon which to coat the upper layers. In addition, the porous base layer may provide a sump for the ink fluids in the ink applied to the uppermost layer by the printer. Schultz, et al. describe a porous intermediate layer present in an amount of at least 25 g/m$^2$ comprising colloidal alumina and a porous top layer comprising alumina in an amount of at least 1 g/m$^2$. The base layer is coated by a post-metering method, e.g. rod coating, followed by drying and then the upper two layers are coated simultaneously by a pre-metering method, e.g. curtain coating. The material is calendered at least once, optionally at any time after the initial base-layer coating, to provide a 20-degree gloss of at least 15 Gardner units in its unprinted state.

The inkjet recording element disclosed by Schultz et al., while providing good image quality and gloss, requires a drying step between the coating of the base layer and the two upper layers because the coating compositions for the base and upper layers, respectively, comprise particles of opposite surface charge which are not compatible. The coating of non-compatible coating compositions, either simultaneously or wet-on-wet, results in coagulation of the coating dispersions, either preventing coating altogether or resulting in low gloss.

As the quality and density of inkjet images increases, so does the amount of ink applied to the inkjet recording element (also referred to as the "receiver"). For this reason, it is important to provide sufficient void capacity in the medium to prevent puddling or coalescence and inter-color bleed. At the same time, print speeds are increasing in order to provide convenience to the user. Thus, not only is sufficient capacity required to accommodate the increased amount of ink, but in addition, the medium must be able to handle increasingly greater ink flux in terms of ink volume/unit area/unit time.

The element of Schultz, et al. is capable of absorbing a high ink flux without coalescence and of providing a desirable level of gloss. The base-layer coating composition containing calcium carbonate is not compatible with the upper-layer coating compositions containing alumina. Simultaneous coating of calcium carbonate-containing compositions with alumina-containing compositions is precluded by the tendency of incompatible compositions to foul the coating apparatus as they make contact. Furthermore, the total amount of water necessary to coat a dry solids load of greater than 50 g/m$^2$ presents a problem to dry with satisfactory results. Harsh drying conditions lead to cracking problems, but gentler drying conditions are less productive.

Chen et al. in U.S. Pat. No. 6,150,289 describe a matte surface inkjet receiver comprising a plain paper support with a coated layer of clay particles treated with a cationic polymer to render the surface charge of the particles positive. Seventy percent of the particles have an equivalent spherical diameter greater than 0.5 micron. They do not suggest a means of preparing a glossy inkjet receiver using this coating composition.

In view of the above, the production of high quality, high capacity, high gloss porous inkjet receiver materials has been complicated by multilayer structures, high coated weights of one or more layers, and relatively expensive materials or complicated manufacturing processes.

There remains an unfulfilled need for a photographic quality inkjet receiving material that is manufacturable using low-cost materials in an efficient process requiring only a single coating and drying step and that gives images with excellent gloss, color density, and image quality.

SUMMARY OF THE INVENTION

The invention provides an inkjet printing system that comprises:

a) an inkjet printer;

b) an ink composition; and c) an inkjet recording media comprising a support, and coated on said support in order from the support, a porous base layer, a porous intermediate layer, and a porous uppermost layer, wherein:

1) the porous base layer comprises a binder and clay particles treated with a cationic surface modifier to provide a zeta potential with a positive sign, said clay having a median particle diameter less than 1.0 micron;

2) the porous intermediate layer and porous uppermost layers independently comprise particles of a semi-metallic or metallic oxide, either having or treated to have a zeta potential with a positive sign, said particles having median secondary particle diameter less than 500 nm; and 3) the ratio of the millimole equivalents of cationic modifier to grams of clay particles in the base layer is greater than 0.1.

The invention also provides a recording media and method of making the media. The inkjet recording media is manufacturable using low-cost materials in an efficient process requiring only a single coating and drying step and the printing system provides images with excellent gloss, color density, and image quality.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

The invention is summarized above. Inkjet printing systems useful in the invention comprise a printer, at least one ink, and an image recording element, typically a sheet, (herein also "media"), suitable for receiving ink from an inkjet printer. Inkjet printing is a non-impact method for producing printed images by the deposition of ink droplets in a pixel-by-pixel manner to an image-recording element in response to digital data signals. There are various methods that may be utilized to control the deposition of ink droplets on the image-recording element to yield the desired printed image. In one process, known as drop-on-demand inkjet, individual ink droplets are projected as needed onto the image-recording element to form the desired printed image. Common methods of controlling the projection of ink droplets in drop-on-demand printing include piezoelectric transducers, thermal bubble formation or an actuator that is made to move.

Drop-on-demand (DOD) liquid emission devices have been known as ink printing devices in inkjet printing systems for many years. Early devices were based on piezoelectric actuators such as are disclosed by Kyser et al., in U.S. Pat. No. 3,946,398 and Stemme in U.S. Pat. No. 3,747,120. A currently popular form of inkjet printing, thermal inkjet (or "thermal bubble jet"), uses electrically resistive heaters to generate vapor bubbles which cause drop emission, as is discussed by Hara, et al., in U.S. Pat. No. 4,296,421. In another process, known as continuous inkjet, a continuous stream of droplets is generated, a portion of which are deflected in an image-wise manner onto the surface of the image-recording element, while un-imaged droplets are caught and returned to an ink sump. Continuous inkjet printers are disclosed in U.S. Pat. Nos. 6,588,888; 6,554,410; 6,682,182; 6,793,328; 6,866,370; 6,575,566; and 6,517,197.

Figure 1:
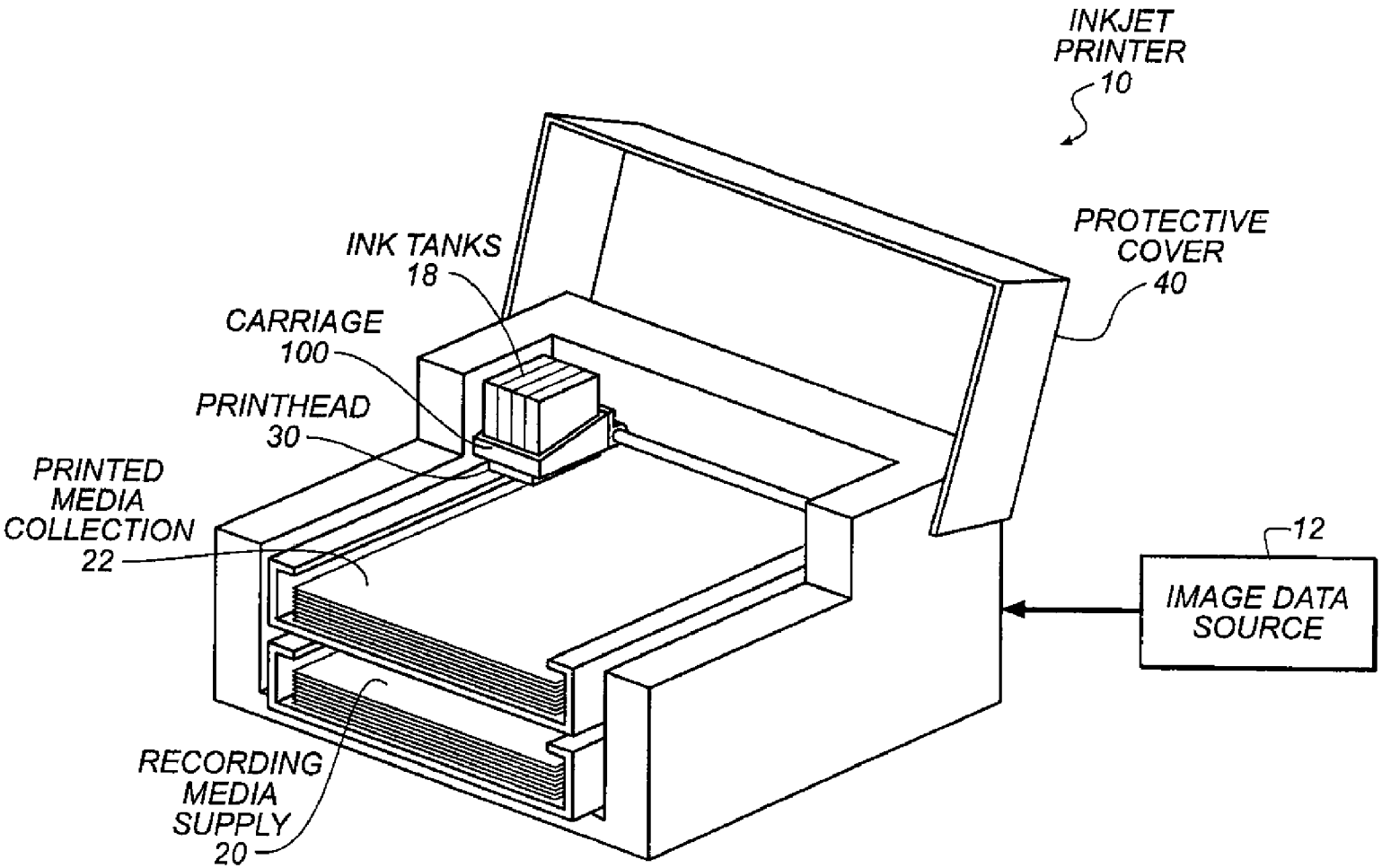
FIG. 1 is a schematic view of an inkjet printer useful in the invention.

FIG. 1 shows one schematic example of an inkjet printer 10 that includes a protective cover 40 for the internal components of the printer. The printer contains a media supply 20 in a tray. The printer includes one or more ink tanks 18 (shown here as having four inks) that supply ink to a printhead 30. The printhead 30 and ink tanks 18 are mounted on a carriage 100. The printer includes a source of image data 12 that provides signals that are interpreted by a controller (not shown) as being commands to eject drops of ink from the printhead 30. Printheads may be integral with the ink tanks or separate. Exemplary printheads are described in U.S. Pat. No. 7,350,902. In a typical printing operation a media sheet travels from the recording media (or inkjet receiver) supply 20 in a media supply tray to a region where the printhead 30 deposits droplets of ink onto the media sheet. The printed media collection 22 is accumulated in an output tray.

Figure 2:
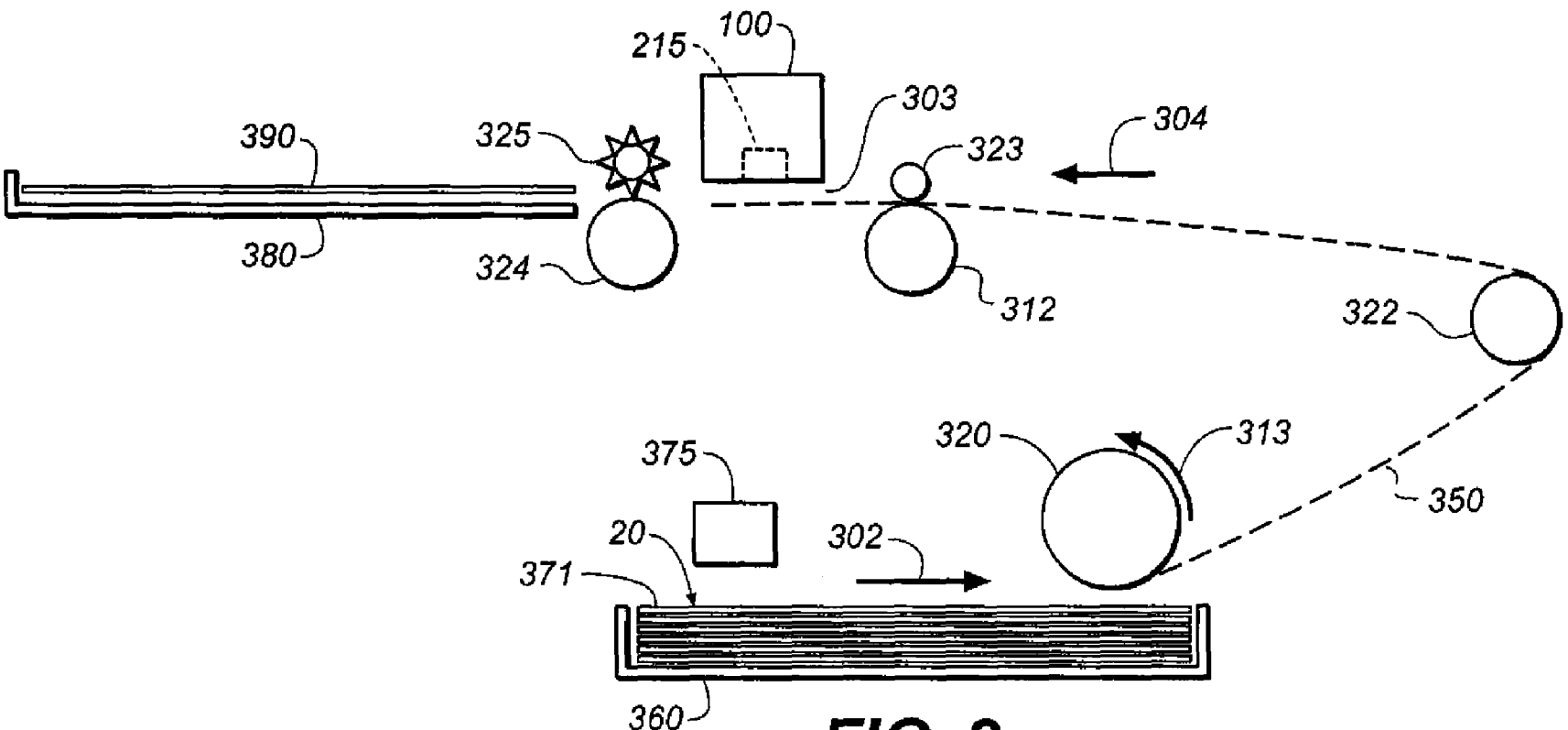
FIG. 2 is a schematic diagram showing the flow of media from the supply tray of an inkjet printer to the collection tray.

FIG. 2 shows schematically how the inkjet printer comprises a variety of rollers to advance the media sheet, through the printer, as shown schematically in the side view of FIG. 2. In this example, a pickup roller 320 moves the top media sheet 371 of a stack 20 of media that is located in a media supply tray 360 in the direction of arrow 302. A turn roller 322 acts to move the media sheet 371 around a C-shaped path 350 (in cooperation with a curved surface—not shown) so that the media sheet continues to advance along direction arrow 304 in the printer. The media sheet 371 is then moved by feed roller 312 and idler roller(s) 323 to advance along direction 304 across the print region 303 and under printer carriage 100. A discharge roller 324 and star wheel(s) 325 transport the printed media sheet 390 along direction 304 and to an output tray 380. For normal media pick-up and feeding, it is desired that all driven rollers rotate in forward direction 313. An optional sensor 215 capable of detecting properties of the media sheet or indicia contained thereon can be mounted on the carriage 100. A further optional sensor 375 capable of detecting properties of the media sheet or indicia contained thereon may be positioned facing the front or back surface of the media sheet 371 and located at any advantageous position along the media transport path 350 including the media supply tray 360. Alternatively, the inkjet printing system comprises a printer supplied with a continuous roll of ink recording medium that may be cut to individual prints subsequent to printing.

Different types of image-recording elements (media) vary widely in their ability to absorb ink. Inkjet printing systems provide a number of different print modes designed for specific media types. A print mode is a set of rules for determining the amount, placement, and timing of the jetting of ink droplets during the printing operation. For optimal image reproduction in inkjet printing, the printing system must match the supplied media type with the correct print mode. The printing system may rely on the user interface to receive the identity of the supplied media, or an automated media detection system may be employed. A media detection system comprises a media detector, signal conditioning procedures, and an algorithm or look-up table to decide the media identity. The media detector may be configured to sense indicia present on the media comprising logos, or patterns corresponding to media type, or may be configured to detect inherent media properties, typically optical reflection. The media optical sensor may be located in a position to view either the front or back of the media sheet, depending on the property being detected. As exemplified in FIG. 2, the optical sensor 375 may be located to view the media sheet 371 in the media supply tray 360 or along the media transport path 350. Alternatively, optical sensor 215 may be located at the print region 303. Usefully, the media comprises a repeating pattern detectable by the method described in U.S. Pat. No. 7,120,272. Alternatively, a number of media detection methods are described in U.S. Pat. No. 6,585,341.

The ink compositions known in the art of inkjet printing may be aqueous- or solvent-based, and in a liquid, solid, or gel state at room temperature and pressure. Aqueous-based ink compositions are preferred because they are more environmentally friendly as compared to solvent-based inks, plus most printheads are designed for use with aqueous-based inks.

The ink composition may be colored with pigments, dyes, polymeric dyes, loaded-dye/latex particles, or any other types of colorants, or combinations thereof. Pigment-based ink compositions are used because such inks render printed images giving comparable optical densities with better resistance to light and ozone as compared to printed images made from other types of colorants. The colorant in the ink composition may be yellow, magenta, cyan, black, gray, red, violet, blue, green, orange, brown, etc.

A challenge for inkjet printing is the stability and durability of the image created on the various types of inkjet receivers. It is generally known that inks employing pigments as ink colorants provide superior image stability relative to dye based inks for light fade and fade due to environmental pollutants especially when printed on microporous photoglossy receivers. For good physical durability (for example abrasion resistance) pigment based inks can be improved by addition of a binder polymer in the ink composition.

Ink compositions useful in the present invention are aqueous-based. Aqueous-based is defined herein to mean the majority of the liquid components in the ink composition are water, preferably greater than 50% water, and more preferably greater than 60% water.

The water compositions useful in the invention may also include humectants and/or co-solvents in order to prevent the ink composition from drying out or crusting in the nozzles of the printhead, aid solubility of the components in the ink composition, or facilitate penetration of the ink composition into the image-recording element after printing. Representative examples of humectants and co-solvents used in aqueous-based ink compositions include: (1) alcohols, such as methyl alcohol, ethyl alcohol, n-propyl alcohol, isopropyl alcohol, n-butyl alcohol, sec-butyl alcohol, t-butyl alcohol, iso-butyl alcohol, fufuryl alcohol, and tetrahydrofurfuryl alcohol; (2) polyhydric alcohols, such as ethylene glycol, diethylene glycol, triethylene glycol, tetraethylene glycol, propylene glycol, polyethylene glycol, polypropylene glycol, 1,2-propane diol, 1,3-propane diol, 1,2-butane diol, 1,3-butane diol, 1,4-butane diol, 1,2-pentane diol, 1,5-pentanediol, 1,2-hexanediol, 1,6-hexane diol, 2-methyl-2,4-pentanediol, 1,2-heptane diol, 1,7-hexane diol, 2-ethyl-1,3-hexane diol, 1,2-octane diol, 2,2,4-trimethyl-1,3-pentane diol, 1,8-octane diol, glycerol, 1,2,6-hexanetriol, 2-ethyl-2-hydroxymethylpropane diol, saccharides and sugar alcohols, and thioglycol; (3) lower mono- and di-alkyl ethers derived from the polyhydric alcohols; such as, ethylene glycol monomethyl ether, ethylene glycol monobutyl ether, ethylene glycol monoethyl ether acetate, diethylene glycol monomethyl ether, and diethylene glycol monobutyl ether acetate; (4) nitrogen-containing compounds such as urea, 2-pyrrolidone, N-methyl-2-pyrrolidone, and 1,3-dimethyl-2-imidazolidinone; and (5) sulfur-containing compounds such as 2,2'-thiodiethanol, dimethyl sulfoxide, and tetramethylene sulfone.

The ink compositions useful in the invention are pigment-based because such inks render printed images having higher optical densities and better resistance to light and ozone as compared to printed images made from other types of colorants. Pigments that may be used in the inks useful in the invention include those disclosed in, for example, U.S. Pat. Nos. 5,026,427; 5,085,698; 5,141,556; 5,160,370; and 5,169,436. The exact choice of pigments will depend upon the specific application and performance requirements such as color reproduction and image stability.

Pigments suitable for use in the invention include, but are not limited to, azo pigments, monoazo pigments, diazo pigments, azo pigment lakes, b-Naphthol pigments, Naphthol AS pigments, benzimidazolone pigments, disazo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black.

Typical examples of pigments that may be used include Color Index (C. I.) Pigment Yellow 1, 2, 3, 5, 6, 10, 12, 13, 14, 16, 17, 62, 65, 73, 74, 75, 81, 83, 87, 90, 93, 94, 95, 97, 98, 99, 100, 101, 104, 106, 108, 109, 110, 111, 113, 114, 116, 117, 120, 121, 123, 124, 126, 127, 128, 129, 130, 133, 136, 138, 139, 147, 148, 150, 151, 152, 153, 154, 155, 165, 166, 167, 168, 169, 170, 171, 172, 173, 174, 175, 176, 177, 179, 180, 181, 182, 183, 184, 185, 187, 188, 190, 191, 192, 193, 194; C.I. Pigment Red 1, 2, 3, 4, 5, 6, 7, 8, 9, 10, 11, 12, 13, 14, 15, 16, 17, 18, 21, 22, 23, 31, 32, 38, 48:1, 48:2, 48:3, 48:4, 49:1, 49:2, 49:3, 50:1, 51, 52:1, 52:2, 53:1, 57:1, 60:1, 63:1, 66, 67, 68, 81, 95, 112, 114, 119, 122, 136, 144, 146, 147, 148, 149, 150, 151, 164, 166, 168, 169, 170, 171, 172, 175, 176, 177, 178, 179, 181, 184, 185, 187, 188, 190, 192, 194, 200, 202, 204, 206, 207, 210, 211, 212, 213, 214, 216, 220, 222, 237, 238, 239, 240, 242, 243, 245, 247, 248, 251, 252, 253, 254, 255, 256, 258, 261, 264; C.I. Pigment Blue 1, 2, 9, 10, 14, 15:1, 15:2, 15:3, 15:4, 15:6, 15, 16, 18, 19, 24:1, 25, 56, 60, 61, 62, 63, 64, 66, bridged aluminum phthalocyanine pigments; C.I. Pigment Black 1, 7, 20, 31, 32; C. I. Pigment Orange 1, 2, 5, 6, 13, 15, 16, 17, 17:1, 19, 22, 24, 31, 34, 36, 38, 40, 43, 44, 46, 48, 49, 51, 59, 60, 61, 62, 64, 65, 66, 67, 68, 69; C.I. Pigment Green 1, 2, 4, 7, 8, 10, 36, 45; C.I. Pigment Violet 1, 2, 3, 5:1, 13, 19, 23, 25, 27, 29, 31, 32, 37, 39, 42, 44, 50, and mixtures thereof.

Self-dispersing pigments that are dispersible without the use of a dispersant or surfactant may also be useful in the invention. Pigments of this type are those that have been subjected to a surface treatment such as oxidation/reduction, acid/base treatment, or functionalization through coupling chemistry, such that a separate dispersant is not necessary. The surface treatment can render the surface of the pigment with anionic, cationic or non-ionic groups. See for example, U.S. Pat. Nos. 6,494,943 and 5,837,045. Examples of self-dispersing type pigments include CAB-O-JET 200 and CAB-O-JET 300 (Cabot Specialty Chemicals, Inc.) and BONJET CW-1, CW-2 and CW-3 (Orient Chemical Industries, Ltd.). In particular, a self-dispersing carbon black pigment ink may be employed in the ink set useful in the invention, wherein ink comprises a water soluble polymer containing acid groups neutralized by an inorganic base, and the carbon black pigment comprises greater than 11 weight % volatile surface functional groups as disclosed in commonly assigned, copending U.S. Application No. 60/892,137, the disclosure of which is incorporated by reference herein.

Pigment-based ink compositions useful in the invention may be prepared by any method known in the art of inkjet printing. Useful methods commonly involve two steps: (a) a dispersing or milling step to break up the pigments to primary particles, where primary particle is defined as the smallest identifiable subdivision in a particulate system, and (b) a dilution step in which the pigment dispersion from step (a) is diluted with the remaining ink components to give a working strength ink.

The milling step (a) is carried out using any type of grinding mill such as a media mill, ball mill, two-roll mill, three-roll mill, bead mill, and air-jet mill, an attritor, or a liquid interaction chamber. In the milling step (a), pigments are optionally suspended in a medium that is typically the same as or similar to the medium used to dilute the pigment dispersion in step (b). Inert milling media are optionally present in the milling step (a) in order to facilitate break up of the pigments to primary particles. Inert milling media include such materials as polymeric beads, glasses, ceramics, metals, and plastics as described, for example, in U.S. Pat. No. 5,891,231. Milling media are removed from either the pigment dispersion obtained in step (a) or from the ink composition obtained in step (b).

A dispersant is optionally present in the milling step (a) in order to facilitate break up of the pigments into primary particles. For the pigment dispersion obtained in step (a) or the ink composition obtained in step (b), a dispersant is optionally present in order to maintain particle stability and prevent settling. Dispersants suitable for use in the invention include, but are not limited to, those commonly used in the art of inkjet printing. For aqueous pigment-based ink compositions, useful dispersants include anionic, cationic or nonionic surfactants such as sodium dodecylsulfate, or potassium or sodium oleylmethyltaurate as described in, for example, U.S. Pat. Nos. 5,679,138; 5,651,813; or 5,985,017.

Polymeric dispersants are also known and useful in aqueous pigment-based ink compositions. Polymeric dispersants may be added to the pigment dispersion prior to, or during the milling step (a), and include polymers such as homopolymers and copolymers; anionic, cationic, or nonionic polymers; or random, block, branched, or graft polymers. Polymeric dispersants useful in the milling operation include random and block copolymers having hydrophilic and hydrophobic portions; see for example U.S. Pat. Nos. 4,597,794; 5,085,698; 5,519,085; 5,272,201; 5,172, 133; or 6,043,297; and graft copolymers; see for example, U.S. Pat. Nos. 5,231,131; 6,087,416; 5,719,204; or 5,714,538.

Composite colorant particles having a colorant phase and a polymer phase are also useful in aqueous pigment-based inks useful in the invention. Composite colorant particles are formed by polymerizing monomers in the presence of pigments; see for example, US Patent Publication Numbers 2003/0199614, 2003/0203988, or 2004/0127639. Microencapsulated-type pigment particles are also useful and consist of pigment particles coated with a resin film; see for example U.S. Pat. No. 6,074,467.

The pigments used in the ink composition useful in the invention may be present in any effective amount, generally from 0.1 to 10% by weight, and preferably from 0.5 to 6% by weight.

Inkjet ink compositions may also contain non-colored particles such as inorganic particles or polymeric particles. The use of such particulate addenda has increased over the past several years, especially in inkjet ink compositions intended for photographic-quality imaging. For example, U.S. Pat. No. 5,925,178 describes the use of inorganic particles in pigment-based inks in order to improve optical density and rub resistance of the pigment particles on the image-recording element. In another example, U.S. Pat. No. 6,508,548 describes the use of a water-dispersible polymeric latex in dye-based inks in order to improve light and ozone resistance of the printed images.

The ink composition may contain non-colored particles such as inorganic or polymeric particles in order to improve gloss differential, light and/or ozone resistance, waterfastness, rub resistance, and various other properties of a printed image; see for example, U.S. Pat. No. 6,598,967 or U.S. Pat. No. 6,508,548. Colorless ink compositions that contain non-colored particles and no colorant may also be used. For example US Patent Publication No. 2006/0100307 describes an inkjet ink comprising an aqueous medium and microgel particles. Colorless ink compositions are often used in the art as "fixers" or insolubilizing fluids that are printed under, over, or with colored ink compositions in order to reduce bleed between colors and water-fastness on plain paper; see for example, U.S. Pat. No. 5,866,638 or 6,450,632. Colorless inks are also used to provide an overcoat to a printed image, usually in order to improve scratch resistance and waterfastness; see for example, US Patent Publication No. 2002/0009547 or EP 1,022, 151. Colorless inks are also used to reduce gloss differential in a printed image; see for example, U.S. Pat. No. 6,604,819 or US Patent Publication Numbers 2003/0085974, 2003/0193553, or 2003/0189626.

Examples of inorganic particles useful in inks used in the invention include, but are not limited to, alumina, boehmite, clay, calcium carbonate, titanium dioxide, calcined clay, aluminosilicates, silica, or barium sulfate.

For aqueous-based inks, polymeric binders useful in the invention include water-dispersible polymers generally classified as either addition polymers or condensation polymers, both of which are well-known to those skilled in the art of polymer chemistry. Examples of polymer classes include acrylics, styrenics, polyethylenes, polypropylenes, polyesters, polyamides, polyurethanes, polyureas, polyethers, polycarbonates, polyacid anhydrides, and copolymers consisting of combinations thereof. Such polymer particles can be ionomeric, film-forming, non-film-forming, fusible, or heavily cross-linked and can have a wide range of molecular weights and glass transition temperatures.

Examples of useful polymeric binders include styrene-acrylic copolymers sold under the trade names JONCRYL (S.C. Johnson Co.), UCAR (Dow Chemical Co.), JONREZ (MeadWestvaco Corp.), and VANCRYL (Air Products and Chemicals, Inc.); sulfonated polyesters sold under the trade name EASTMAN AQ (Eastman Chemical Co.); and polyethylene or polypropylene resin emulsions and polyurethanes (such as the WITCOBONDS from Witco). These polymers are preferred because they are compatible in typical aqueous-based ink compositions, and because they render printed images that are highly durable towards physical abrasion, light, and ozone.

The non-colored particles and binders useful in the ink composition used in the invention may be present in any effective amount, generally from 0.01 to 20% by weight, and preferably from 0.01 to 6% by weight. The exact choice of materials will depend upon the specific application and performance requirements of the printed image.

Ink compositions may also contain water-soluble polymer binders. The water-soluble polymers useful in the ink composition are differentiated from polymer particles in that they are soluble in the water phase or combined water/water-soluble solvent phase of the ink. The term "water-soluble" herein means that when the polymer is dissolved in water and when the polymer is at least partially neutralized the resultant solution is visually clear. Included in this class of polymers are nonionic, anionic, amphoteric, and cationic polymers. Representative examples of water soluble polymers include polyvinyl alcohols, polyvinyl acetates, polyvinyl pyrrolidones, carboxy methyl cellulose, polyethyloxazolines, polyethyleneimines, polyamides and alkali soluble resins, polyurethanes (such as those found in U.S. Pat. No. 6,268,101), polyacrylic type polymers such as polyacrylic acid and styrene-acrylic methacrylic acid copolymers (such as JONCRYL 70 from S.C. Johnson Co., TRUDOT IJ-4655 from MeadWestvaco Corp., and VANCRYL 68S from Air Products and Chemicals, Inc.).

Examples of water-soluble acrylic type polymeric additives and water dispersible polycarbonate-type or polyether-type polyurethanes which may be used in the inks of the ink sets useful in the invention are described in copending, commonly assigned U.S. Patent Application Nos. 60/892,158 and 60/892,171, the disclosures of which are incorporated by reference herein. Polymeric binder additives useful in the inks used in the invention are also described in, for example, US Patent Publication Numbers 2006/0100307 and 2006/0100308.

In practice, ink static and dynamic surface tensions are controlled so that inks of an ink set can provide prints with the desired inter-color bleed. In particular, it has been found that the dynamic surface tension at 10 milliseconds surface age for all inks of the ink set comprising cyan, magenta, yellow, and black pigment-based inks and a colorless protective ink should be greater than or equal to 35 mN/m, while the static surface tensions of the yellow ink and of the colorless protective ink should be at least 2.0 mN/m lower than the static surface tensions of the cyan, magenta, and black inks of the ink set, and the static surface tension of the colorless protective ink should be at least 1.0 mN/m lower than the static surface tension of the yellow ink in order to provide acceptable performance for inter-color bleed on both microporous photoglossy and plain paper. It is generally preferred that the static surface tension of the yellow ink is at least 2.0 mN/m lower than all other inks of the ink set excluding the clear protective ink, and the static surface tension of the clear protective ink is at least 2.0 mN/m lower than all other inks of the ink set excluding the yellow ink.

Surfactants may be added to adjust the surface tension of the inks to appropriate levels. The surfactants may be anionic, cationic, amphoteric, or nonionic and used at levels of 0.01 to 5% of the ink composition. Examples of suitable nonionic surfactants include linear or secondary alcohol ethoxylates (such as the TERGITOL 15-S and TERGITOL TMN series available from Union Carbide and the BRIJ series from Uniquema), ethoxylated alkyl phenols (such as the TRITON series from Union Carbide), fluoro surfactants (such as the ZONYLS from DuPont and the FLUORADS from 3M), fatty acid ethoxylates, fatty amide ethoxylates, ethoxylated and propoxylated block copolymers (such as the PLURONIC and TETRONIC series from BASF), ethoxylated and propoxylated silicone based surfactants (such as the SILWET series from CK Witco), alkyl polyglycosides (such as the GLUCOPONS from Cognis), and acetylenic polyethylene oxide surfactants (such as the SURFYNOLS from Air Products and Chemicals, Inc.).

Examples of anionic surfactants include: carboxylated (such as ether carboxylates and sulfosuccinates), sulfated (such as sodium dodecyl sulfate), sulfonated (such as dodecyl benzene sulfonate, alpha olefin sulfonates, alkyl diphenyl oxide disulfonates, fatty acid taurates, and alkyl naphthalene sulfonates), phosphated (such as phosphated esters of alkyl and aryl alcohols, including the STRODEX series from Dexter Chemical), phosphonated and amine oxide surfactants, and anionic fluorinated surfactants. Examples of amphoteric surfactants include: betaines, sultaines, and aminopropionates. Examples of cationic surfactants include: quaternary ammonium compounds, cationic amine oxides, ethoxylated fatty amines, and imidazoline surfactants. Additional examples of the above surfactants are described in "McCutcheon's Emulsifiers and Detergents: 2003, North American Edition."

A biocide may be added to an inkjet ink composition to suppress the growth of micro-organisms such as molds, fungi, etc. in aqueous inks. A preferred biocide for an ink composition is PROXEL GXL (Zeneca Specialties Co.) at a final concentration of 0.0001-0.5 wt. %. Additional additives which may optionally be present in an inkjet ink composition include thickeners, conductivity enhancing agents, anti-kogation agents, drying agents, waterfast agents, dye solubilizers, chelating agents, binders, light stabilizers, viscosifiers, buffering agents, anti-mold agents, anti-curl agents, stabilizers, and defoamers.

The pH of the aqueous ink compositions useful in the invention may be adjusted by the addition of organic or inorganic acids or bases. Useful inks may have a preferred pH of from about 2 to 10, depending upon the type of dye or pigment being used. Typical inorganic acids include hydrochloric, phosphoric, and sulfuric acids. Typical organic acids include methanesulfonic, acetic, and lactic acids. Typical inorganic bases include alkali metal hydroxides and carbonates. Typical organic bases include ammonia, triethanolamine, and tetramethylethlenediamine.

The exact choice of ink components will depend upon the specific application and performance requirements of the printhead from which they are jetted. Thermal and piezoelectric drop-on-demand printheads and continuous printheads each require ink compositions with a different set of physical properties in order to achieve reliable and accurate jetting of the ink, as is well known in the art of inkjet printing. Acceptable viscosities are no greater than 20 cP, and preferably in the range of about 1.0 to 6.0 cP.

For color inkjet printing, a minimum of cyan, magenta, and yellow inks are required for an inkjet ink set which is intended to function as a subtractive color system. Very often black ink is added to the ink set to decrease the ink required to render dark areas in an image and for printing of black and white documents such as text. The need to print on both microporous photoglossy and plain paper receivers may be met by providing a plurality of black inks in an ink set. In this case, one of the black inks may be better suited to printing on microporous photoglossy receivers while another black ink may be better suited to printing on plain paper. Use of separate black ink formulations for this purpose can be justified based on desired print densities, printed gloss, and smudge resistance for the type of receiver.

Other inks can be added to the ink set. These inks include light or dilute cyan, light or dilute magenta, light or dilute black, red, blue, green, orange, gray, and the like. Additional inks can be beneficial for image quality but they add system complexity and cost. Finally, colorless ink composition can be added to the inkjet ink set for the purpose of providing gloss uniformity, durability and stain resistance to areas in the printed image which receive little or no ink otherwise. Even for image areas printed with a significant level of colorant containing inks, the colorless ink composition can be added to those areas with further benefits. An example of a protective ink for the above purposes is described in US Patent Publication Numbers 2006/0100306 and 2006/0100308.

In describing the invention herein, the following definitions generally apply:

The term "single coating pass" or "one coating pass" refers to a coating operation comprising coating one or more layers, optionally at one or more stations, in which the coating operation occurs prior to winding the inkjet recording material in a roll. A coating operation, in which farther a coating step occurs before and again after winding the inkjet recording material on a roll, but prior to winding the inkjet recording material in a roll a second time, is referred to as a two-pass coating operation.

The term "post-metering method" is defined herein to mean a method in which the coating composition is metered after coating, by removing excess material that has been coated.

The term "pre-metering method" is defined herein to mean a direct metering method, by which is meant a method in which the coating composition is metered before coating, for example, by a pump. Pre-metered methods can be selected from, for example, curtain coating, extrusion hopper coating, and slide hopper coating.

The term "porous layer" is used herein to define a layer that is characterized by absorbing applied ink primarily by means of capillary action rather than liquid diffusion. The porosity is based on pores formed by the spacing between particles, although porosity can be affected by the particle to binder ratio. The porosity of a layer may be predicted based on the critical pigment volume concentration (CPVC). An inkjet recording media having one or more porous layers, preferably substantially all layers, over the support can be referred to as a "porous inkjet recording media" even though at least the support is not considered porous.

Particle sizes referred to herein, unless otherwise indicated, are median particle sizes as determined by light scattering measurements of diluted particles dispersed in water, as measured using laser diffraction or photon correlation spectroscopy (PCS) techniques employing NANOTRAC (Microtac Inc.), MALVERN, or CILAS instruments or essentially equivalent means, which information is often provided in product literature. For particle sizes greater than 0.3 micrometers, particle measurements are by a Micromeritics SEDIGRAPH 5100 or equivalent means. For particle sizes not more than about 50 nm, particle measurements are by direct methods, transmission electron microscopy (TEM) of a representative sample or equivalent means. Unless otherwise indicated particle sizes refer to secondary particle size.

As used herein, the terms "over," "above," "upper," "under," "below," "lower," with respect to layers in inkjet media, refer to the order of the layers over the support, but do not necessarily indicate that the layers are immediately adjacent or that there are no intermediate layers.

The term "image-receiving layer" is intended to define a layer that is used as a pigment-trapping layer, dye-trapping layer, or dye-and-pigment-trapping layer, in which the printed image substantially resides throughout the layer. Typically, an image-receiving layer comprises a mordant for dye-based inks. In the case of a dye-based ink, the image may optionally reside in more than one image-receiving layer.

The term "base layer" (sometimes also referred to as a "sump layer" or "ink-carrier-liquid receptive layer") is used herein to mean a layer under at least one other ink-retaining layer that absorbs a substantial amount of ink-carrier liquid. In use, a substantial amount, often most, of the carrier fluid for the ink is received in the base layer. The base layer is not above an image-containing layer and is not itself an image-containing layer (a pigment-trapping layer or dye-trapping layer). Typically, the base layer is the ink-retaining layer nearest the support.

The term "ink-receptive layer" or "ink-retaining layer" includes any and all layers above the support that are receptive to an applied ink composition, that absorb or trap any part of the one or more ink compositions used to form the image in the inkjet recording element, including the ink-carrier fluid and/or the colorant, even if later removed by drying. An ink-receptive layer, therefore, can include an image-receiving layer, in which the image is formed by a dye and/or pigment, a base layer, or any additional layers, for example between a base layer and a topmost layer of the inkjet recording element. Typically, all layers above the support are ink-receptive. The support on which ink-receptive layers are coated may also absorb ink-carrier fluid, in which it is referred to as an ink-absorptive or absorbent layer rather than an ink-receptive layer.

The term "precipitated calcium carbonate" is used herein to define a synthetically produced calcium carbonate, not based on calcium carbonate found in nature.

Metallic-oxide and semi-metallic oxide particles can be divided roughly into particles that are made by a wet process and particles made by a dry process (gas phase or vapor phase process). The latter type of particles is also referred to as fumed or pyrogenic particles. In a vapor phase method, flame hydrolysis methods and arc methods have been commercially used. Fumed particles exhibit different properties than non-fumed or hydrated particles. In the case of fumed silica, this may be due to the difference in density of the silanol group on the surface. Fumed particles are suitable for forming a three-dimensional structure having high void ratio.

Fumed or pyrogenic particles are aggregates of smaller, primary particles. Although the primary particles are not porous, the aggregates contain a significant void volume, and hence are capable of rapid liquid absorption. These void-containing aggregates enable a coating to retain a significant capacity for liquid absorption even when the aggregate particles are densely packed, which minimizes the inter-particle void volume of the coating. For example, fumed alumina particles, for selective optional use in the present invention, are described in US Patent Publication No. 2005/0170107.

The term "plain paper" refers to paper that has less than 1 $g/m^2$ of coating applied over raw paper. The term "raw paper" refers to cellulosic paper, the surface of which does not have a continuous layer or coating of a separate material over the cellulose fibers of the paper, although the paper may be treated with a sizing agent or be impregnated with treatment materials over a portion of the surface.

The base layer of the present invention is advantageously combined with a plain paper support to provide ink fluid absorption, smoothing, and capability for gloss development with a mild extent of calendering. The base layer preferably comprises at least 50 percent by weight of inorganic particles to provide porosity, advantageously at least 80 percent by weight, typically at least 90 percent by weight, suitably at least 95 percent by weight. At least 50 percent by weight of the particles comprise particles of clay, typically at least 70 percent by weight of particles.

Clays are generally crystalline hydrous phyllosilicates of one or more of aluminum, iron, and magnesium, comprising layers of tetrahedral and octahedral coordination of the metallic or semi-metallic atoms variously arranged, and further comprising intervening layers of hydration, according to the mineral type. Kaolin has the composition $Al_2O_3.2SiO_2.2H_2O$. Kaolin typically is used as a filler in the manufacture of paper, wherein it is mixed with the pulp fibers, and is known in the art for its brightness and opacity. The process of calcining, i.e., heat-treating kaolin at about 500 to 1000 C, dehydroxylates the kaolin, leaving an amorphous aluminosilicate phase capable of providing improved brightness and opacity. As a major constituent of a base layer coated on plain paper support, kaolin provides a suitable substrate for developing gloss of the upper layer or layers by a mild extent of calendering.

Examples of kaolin that can be used in the present invention include KAOGLOSS 90 (available from Thiele), POLYGLOSS 90 (Huber), and HYDRAFINE 90 (Huber).

The base layer of the present invention comprises at least 2 percent by weight of binder, typically at least 4 percent binder. Sufficient binder is used to prevent cracking upon drying after coating. The amount of binder is desirably limited, because when ink is applied to inkjet media, the (typically aqueous) liquid carrier tends to swell the binder and close the pores and may cause bleeding or other problems. To maintain porosity, therefore, the base layer comprises less than 25 percent by weight, suitably less than 18 percent by weight, typically less than 10 percent by weight of binder.

Any suitable polymeric binder may be used in the base layer of the inkjet recording element employed in the invention. In a desirable embodiment, the polymeric binder may be any compatible, hydrophilic polymer such as a poly(vinyl alcohol), poly(vinyl pyrrolidone), gelatin, cellulose ether, poly(oxazoline), poly(vinylacetamide), partially hydrolyzed poly(vinyl acetate/vinyl alcohol), poly(acrylic acid), poly (acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, or rhamsan. Suitably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin. In general, good results are also obtained with polyurethanes, vinyl acetate-ethylene copolymers, ethylene-vinyl chloride copolymers, vinyl acetate-vinyl chloride-ethylene terpolymers, acrylic polymers, or derivatives thereof. Typically, the binder is a water-soluble hydrophilic polymer, most suitably a polyhydric alcohol such as a poly(vinyl alcohol).

Other binders can also be used in the base layer of the image recording element such as hydrophobic materials, for example, a poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, and copolymers of vinylacetate and n-butylacrylate. A poly(styrene-co-butadiene) latex is especially suitable. Mixtures of hydrophilic and latex binders are useful, and a mixture of PVA with a poly(styrene-co-butadiene) latex is particularly suitable.

In order to impart mechanical durability to the base layer, crosslinkers that act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid, or a borate salt may be used. Typically, the crosslinker is an aldehyde, an acetal, or a ketal such as 2,3-dihydroxy-1,4-dioxane, or a boron compound.

In particular, in one embodiment, the base layer comprises a binder, in an amount of 2 to 10 weight %, and at least 90% by weight of inorganic particles, wherein at least 60 percent, typically at least 65 percent, desirably at least 70 percent, by weight of the inorganic particles comprise kaolin, typically having a median particle size of 0.2 to 1 micrometers, desirably less than 0.5 micrometer.

In one suitable embodiment, the base layer comprises clay in admixture with up to 40 percent by weight of other particles, based on the total weight of inorganic particles, either organic and/or other inorganic particles, including organic-inorganic composite particles.

Examples of organic particles that may be used in the base layer include polymer beads, including but not limited to acrylic resins such as methyl methacrylate, styrenic resins, cellulose derivatives, polyvinyl resins, ethylene-allyl copolymers, and polycondensation polymers such as polyesters. Hollow styrene beads are a preferred organic particle for certain applications.

Other examples of organic particles that may be used include core/shell particles such as those disclosed in U.S. Pat. No. 6,492,006 and homogeneous particles such as those disclosed in U.S. Pat. No. 6,475,602.

Examples of inorganic particles that may be used in the base layer, in addition to kaolin particles include, for example, silica, alumina, titanium dioxide, talc, or zinc oxide. In one typical embodiment, the kaolin-containing base layer further comprises porous alumina or silica gel.

In one desirable embodiment, the kaolin-containing base layer comprises particles of silica gel in an amount of at least 5 percent, suitably at least 10 percent, advantageously at least 15 percent by weight based on the total inorganic particles in the base layer.

In a desirable embodiment, the average secondary particle diameter of the optional additional organic or inorganic particles is at least 0.3 μm, suitably at least 0.5 μm, typically at least 1.0 μm. The average secondary particle diameter of the optional additional organic or inorganic particles is less than about 5.0 microns. As mentioned above, smaller particles provide smaller capillaries, but tend to be more prone to cracking unless the particle to binder ratio is adjusted downwards in view of the large surface area created by the particles. On the other hand, particles that are too large may be brittle or prone to cracking because of fewer contact points, for example, if the coating has a thickness equal to only a few beads making up the dried coating.

In a typical example of the prior art image-recording element described by Schultz, et al. in US Patent Publication No. 2007/0202279, the base layer comprises precipitated calcium carbonate and silica gel particles. The dried coated weight of the prior art base layer is typically at least about 25 g/m$^2$, more often at least 30 g/m$^2$, depending on the presence of other liquid-carrier absorbing layers. In the present invention, the dried coated weight of the base layer is at least 5 g/m$^2$, desirably at least 7 g/m$^2$, advantageously at least 9 g/m$^2$. Typically, the base layer of the present invention is limited to a dried coated weight less than about 25 g/m$^2$, advantageously to a dried coated weight less than about 20 g/m$^2$, desirably to a dried coated weight less than about 15 g/m$^2$.

As indicated below, other conventional additives may be included in the base layer, which may depend on the particular use for the recording element.

The base layer is located under at least two other porous layers and is capable of absorbing a substantial amount of the liquid carrier applied to the image-recording element, but substantially less dye or pigment than the overlying layer or layers. Desirably, the colorant is held in the upper image-recording layers, therefore the base layer typically does not contain a mordant.

Chemical treatment of particles to add moieties possessing an opposite charge permits the natural charge of the particle to be reversed. Surface charge of particles may be characterized by the zeta potential, which is the electrical potential between the dispersion medium and the stationary layer of fluid attached to the dispersed particle. The zeta potential may be estimated by measuring the electrophoretic mobility, according to ASTM Standard D 4187-82 (1985).

A cationic surface modifier providing a positive charge is desired since it renders the particles dispersible and chemically compatible with other components of adjacent ink receiving layers such as mordants, surfactants, and other positively charged particulates. Suitably, the zeta potential of the treated particles is at least +20 mV at any point between pH 2 to 6. This is desirable because the colloidal stability of the particles tends to increase with increasing zeta potential.

The clay particles of the base layer of the present invention are treated with a cationic surface modifier. The cationic surface modifier is positively charged or capable of providing a positive charge when associated with a clay particle, and may be molecular, polymeric, or particulate. Molecular species suitable for the practice of the invention include weak organic bases such as amines and amides, quaternary amines, and organic and inorganic cations capable of binding to the surface of the clay particles.

Polymeric materials suitable for practice of the invention are selected from cationic polyelectrolytes such as polyalkyleneamines. In one aspect, the cationic polymer useful in the invention possesses a net positive charge. In one aspect, the cationic polymer can be a polymeric amine, such as a polymer of quaternary amines, or a polymer of amines that can be converted to quaternary amines, and combinations thereof. The cationic polymer may also contain two or more different cationic monomers, or contain a cationic monomer and other non-ionic or anionic monomers. Suitable monomers in the cationic polymer include one or more monomers selected from water soluble polyolefins containing quaternary ammonium groups which may be in the polymer chain, for example, epichlorohydrin/dimethylamine copolymers, alkyl- or dialkyldiallylammonium halides, such as dimethyidiallylammonium chloride (DADMAC), diethyldiallyl ammonium chloride, dimethyldiallyl ammonium bromide and diethyldiallyl ammonium bromide, methylacryloyl-oxyethyltrimethyl ammonium chloride, acryloy-oxyethyltrimetbyl ammonium chloride, methacryloy-oxyethyltrimethyl ammonium methosulfate, acryloyoxyethyltrimethyl ammonium methosulfate, or methacrylamido-propyltrimethyl ammonium chloride. Other exemplary monomers include dimethylaminoethylacrylate, dimethylaminoethylmethacrylate, dimethylamino propylmethacrylamide and its methyl chloride or dimethyl sulfate quaternary ammonium salts, dimethylaminoethylacrylate and its methyl chloride salt, methacrylamidopropyltrimethylammonium chloride and its unquaternized amine form, acrylamidopropyltrimethylammonium chloride and its unquaternized amine form, and dimethylamine and epichlorohydrin. Exemplary polymers also include products of copolymerizing epichlorohydrin and amines, especially secondary amines, alone or in combination, and polymers made by polymerizing any of the above listed cationic monomers with non-ionic monomers such as acrylamide, methacrylamide, or N,N-dimethylacrylamide.

Exemplary cationic polymers include polydiallyldimethylammonium chloride (p-DADMAC), copolymers of quaternary dimethylaminoethyl acrylate, and copolymers of quaternary dimethylaminoethyl methacrylate, and copolymers of epichlorohydrin/dimethylamine. Exemplary suitable polymers are commercially available as AGEFLOC B-50LV, NALCO 62060, NALCO 7135, NALCO 7132, and NALCO 8850. Advantageously, the cationic resins are selected from the group poly(diallyldimethylammonium chloride) and polyethyleneimine. A particularly advantageous cationic polymer is very low molecular weight poly(diallyldimethylammonium) chloride, p-DADMAC, available from Aldrich.

Other cationic polymers include condensates of formaldehyde with melamine, urea, or cyanoguanidine. The cationic polymers useful in this invention also include copolymers of the aforementioned cationic monomers with nonionic monomers, such as acrylamide, methacrylamide, vinyl acetate, vinyl alcohol, N-methylolacrylamide, or diacetone acrylamide, and/or anionic monomers, such as acrylic acid, methacrylic acid, AMPS, or maleic acid, such that the net charge of these polymers is cationic.

In one aspect, the cationic polymer can have a weight average molecular weight of at least 1,000 Daltons (Da), suitably at least 10,000 Da, advantageously at least 20,000 Da, as determined by gel permeation chromatography. In another aspect, the cationic polymer can have a weight average molecular weight no more than 1,000,000 Da, typically no more than 500,000 Da, desirably no more than 300,000 Da, advantageously no more than 100,000 Da. Physical blends of cationic polymers containing different cationic moieties or blends of cationic polymers possessing different molecular weight averages and distributions are also contemplated.

Particulate materials suitable as cationic surface modifiers for the clay particles used to form the image-recording media of the invention are metal oxides and insoluble metal salts having a positive zeta potential at any point between about pH 2 to 7. Positively charged latex particles such a polystyrenes and poly(methyl)methacrylates are also contemplated.

In another suitable embodiment, the cationic surface modifier comprises a metal oxide hydroxide complex having the general formula: $M^{n+}(O)_a(OH)_b(A^{p-})_c.xH_2O$, wherein $M^{n+}$ is at least one metal ion;

n is 3 or 4;

A is an organic or inorganic ion;

p is 1, 2 or 3; and x is equal to or greater than 0;

with the proviso that when n is 3, then a, b, and c each comprise a rational number as follows: $0<a<1.5$; $0<b<3$; and $O<pc<3$, so that the charge of the $M^{3+}$ metal ion is balanced; and when n is 4, then a, b, and c each comprise a rational number as follows: $0<a<2$; $0<b<4$; and $0<pc<4$, so that the charge of the $M^{4+}$ metal ion is balanced.

Suitably, the metal ion is chosen from Al, Ti, and Zr, each having a valence of 3 or 4. A particularly preferred metal complex is dialuminum chloride pentahydroxide solution (Grace Davison, $Al_2(OH)_5Cl$).

In another desirable embodiment, the cationic surface modifier comprises an aluminosilicate polymer having the formula: $Al_xSi_yO_a(OH)_b.nH_2O$ where the ratio of x:y is between 1 and 3, and a and b are selected such that the rule of charge neutrality is obeyed; and n is between 0 and 10. Such aluminosilicate polymers suitable for practice of the invention are described in U.S. Pat. No. 7,223,454.

In another embodiment the cationic surface modifier comprises an organosilane or hydrolyzed organosilane, typically silica coupling agents with primary, secondary, or tertiary amino groups or quaternary ammonium groups. More particularly, the organosilane has the formula: $Si(OR)\ aZ_b$ wherein:

R is hydrogen, or a substituted or unsubstituted alkyl group having from 1 to about 20 carbon atoms or a substituted or unsubstituted aryl group having from about 6 to about 20 carbon atoms;

Z is an organic group having from 1 to about 20 carbon atoms or aryl group having from about 6 to about 20 carbon atoms, with at least one of said Z's having at least one primary, secondary, tertiary, or quaternary nitrogen atom;

a is an integer from 1 to 3; and b is an integer from 1 to 3;

with the proviso that a+b=4.

Examples of compounds suitable as cationic surface modifiers include amino-propyltriethoxy silane, N-(2-aminoethyl)-3-aminopropylmethyl dimethoxysilane, diethylenetriamenepropyl triethoxysilane, N-trimethoxysilylpropyl-N,N,N-trimethylammonium chloride, dimethoxysilylmethylpropyl modified polyethyleneimine, N-(3-triethoxylilylpropyl)-4,5-dihydroimidazole, and aminoalkylsilsesquioxane.

The surface of clay particles usually carries a net negative charge. While not wishing to be bound by any particular theory, one may speculate that mixing of the cationic modifier with the anionic clay results in the reaction of the modifier at the negatively charged sites on the surface of the clay to form a salt bond between the clay surface and the modifier. In the case of a polymeric cationic modifier, a single polymer strand may react with multiple sites on the surface of a single clay particle or bridge sites between particles, causing particle aggregation or coagulation. In the presence of sufficient cationic modifier, many of the negative sites on the surface of the clay are neutralized and the modified clay surface acquires a net positive charge. The presence of this net positive charge provides the energy needed to repulse or disperse other modified clay particles, thus the cationic modifier acts as a dispersant in the aqueous slurry containing the modified clay particles.

The porous layers above the base layer contain interconnecting voids that can provide a pathway for the liquid components of applied ink to penetrate appreciably into the base layer, thus allowing the base layer to contribute to the ink-absorbing capacity. A non-porous layer or a layer that contains closed cells would not allow underlying layers to contribute to the ink-absorbing capacity.

As indicated above, the inkjet recording element comprises, over the base layer, a porous ink-receiving intermediate layer, optionally divided into one or more sub-layers, comprising greater than 50 percent, by weight of the layer, of particles of one or more materials having a median particle diameter less than 500 nm, suitably less than 300 nm, and desirably less than 150 nm diameter wherein the intermediate layer is present in an amount of 25 $g/m^2$ to 60 $g/m^2$.

Suitably, the one or more materials in the ink-receiving intermediate layer comprise particles of hydrated or unhydrated aluminum oxide. Advantageously, the one or more materials are substantially non-aggregated colloidal particles. Desirably, the one or more materials comprise a hydrated alumina that is an aluminum oxyhydroxide material, for example, and boehmite.

Typically the one or more materials in the ink-receiving intermediate layer comprise from 75 to 100 percent of the inorganic particles in the ink-receiving intermediate layer.

The term "hydrated alumina" is herein defined by the following general formula:

$$Al_2O_{3-n}(OH)_{2n}.mH_2O$$

wherein n is an integer of 0 to 3, and m is a number of 0 to 10, preferably 0 to 5. In many cases, $mH_2O$ represents an aqueous phase that does not participate in the formation of a crystal lattice, but is able to be eliminated. Therefore, m may take a value other than an integer. However, m and n are not 0 at the same time.

The term "unhydrated alumina" is herein defined by the above formula when m and n are both zero at the same time and includes fumed alumina, made in a dry phase process or anhydrous alumina $Al_2O_3$ made by calcining hydrated alumina. As used herein, such terms as unhydrated alumina apply to the dry materials used to make coating compositions during the manufacture of the inkjet recording element, notwithstanding any hydration that occurs after addition to water.

A crystal of the hydrated alumina showing a boehmite structure is generally a layered material, the (020) plane of which forms a macro-plane, and shows a characteristic diffraction peak. Besides a perfect boehmite, a structure called pseudo-boehmite and containing excess water between layers of the (020) plane may be taken. The X-ray diffraction pattern of this pseudo-boehmite shows a diffraction peak broader than that of the perfect boehmite. Since perfect boehmite and pseudo-boehmite may not be clearly distinguished from each other, the term "boehmite" or "boehmite structure" is herein used to include both unless indicated otherwise by the context. For the purposes of this specification, the term "boehmite" implies boehmite and/or pseudoboehmite.

Boehmite and pseudoboehmite are aluminum oxyhydroxides which are herein defined by the general formula γ-AlO(OH) $xH_2O$, wherein x is 0 to 1. When x=0 the material is specifically boehmite as compared to pseudo-boehmite; when x>0 and the materials incorporate water into their crystalline structure, they are known as pseudoboehmite. Boehmite and pseudoboehmite are also described as $Al_2O_3.zH_2O$ where, when z=1 the material is boehmite and when 1<z<2 the material is pseudoboehmite. The above materials are differentiated from the aluminum hydroxides (e.g. $Al(OH)_3$, bayerite and gibbsite) and diaspore (α-AlO(OOH)) by their compositions and crystal structures. As indicated above, boehmite is usually well crystallized and, in one embodiment, has a structure in accordance with the x-ray diffraction pattern given in the JCPDS-ICDD powder diffraction file 21-1307, whereas pseudoboehmite is less well crystallized and generally presents an XRD pattern with relatively broadened peaks with lower intensities.

The term "aluminum oxyhydroxide" is herein defined to be broadly construed to include any material whose surface is or can be processed to form a shell or layer of the general formula γ-AlO(OH) $xH_2O$ (preferably boehmite), such materials including aluminum metal, aluminum nitride, aluminum oxynitride (AlON), α-$Al_2O_3$, γ-$Al_2O_3$, transitional aluminas of the general formula $Al_2O_3$, boehmite (γ-AlO(OH)), pseudoboehmite ((γ-AlO(OH)).$xH_2O$ where 0<x<1), diaspore (α-AlO(OH)), and the aluminum hydroxides ($Al(OH)_3$) of bayerite and gibbsite. Thus, aluminum oxyhydroxide particles include any finely divided materials with at least a surface shell comprising aluminum oxyhydroxide. In one advantageous embodiment, the core and shell of the particles are both of the same material and comprise boehmite with a BET surface area of over 100 $m^2/g$.

In a typical embodiment, the colloidal alumina used in the intermediate layer comprises a larger crystallite size than the colloidal alumina in the upper layer, as measured by X-ray diffraction ($d_{50}$) on powdered alumina samples using X-ray diffractometers by Siemens or Philips or equivalent means. Typically, the crystallite size in the intermediate layer is at least 25 nm, suitably at least 30 nm. Typically the crystallite size in the uppermost layer is less than 25 nm and at least 15 nm.

Alternatively, the intermediate layer comprises silica particles. Suitably, the particles comprise at least 50% by weight of fumed silica particles. Typically fumed silica particles comprise at least 75% by weight of the inorganic particles in the intermediate layer. Advantageously the silica particles useful in the intermediate layer are treated with a cationic modifier selected from the types disclosed above for use with kaolin particles.

As indicated above, the inkjet recording element comprises, over the porous ink-receiving intermediate layer, a porous image-receiving upper layer. In one embodiment, the uppermost layer comprises greater than 50 percent, by weight of the layer, of a mixture of materials having a median particle size including (i) non-aggregated colloidal particles of one or more materials having a median particle size of under 200 nm, suitably under 150 nm, desirably under 140 nm and at least 80 nm, suitably at least 100 nm. Advantageously, the particles (i) are at least 10 percent smaller, suitably at least 20 percent smaller, than the particles of the one or more second materials, and (ii) aggregated colloidal particles of one or more materials having a median secondary particle size up to 250 nm, suitably up to 200 nm, desirably up to 150 nm, and a primary average particle size of 7 to 40 nm, which porous image-receiving layer is present in an amount of 1 to 10 $g/m^2$ based on dry weight coverage. The upper layer advantageously comprises the highest concentration and amount of mordant, typically a cationic polymer.

Suitably, the one or more materials in the first embodiment of the image-receiving upper layer comprise particles of hydrated or unhydrated metallic oxide, wherein the aggregated colloidal particles are fumed metallic oxide. Desirably, the fumed particles are present in an amount of 25 to 75 weight percent based on total inorganic particles in the layer. Advantageously, fumed alumina, and the non-aggregated colloidal particles in the image-receiving upper layer is present in an amount of 25 to 75 weight percent based on the total inorganic particles in the layer. In such mixtures, the difference between the mean aggregate particle sizes of the two types of particles typically is within about 25 percent, desirably within 20 percent. Examples of useful colloidal particles include, for example, hydrated alumina (including aluminum oxyhydroxides such as boehmite), alumina, silica, aluminosilicates, titanium dioxide, and zirconium dioxide.

Suitably, the non-aggregated colloidal particles comprise aluminum oxyhydroxide material or colloidal (non-aggregated) silica, as described above for the porous ink-receiving intermediate layer, other than particle size.

When the uppermost and intermediate layers of the present invention contain at least 50 percent alumina, the concentration of fumed alumina particles in the upper image-receiving layer is greater than the concentration in the ink-receiving intermediate layer, if any, relative to other inorganic particles in the layer. Suitably, the concentration of fumed alumina particles in the upper image-receiving layer, relative to other inorganic particles in the layer, is more than twice, advantageously more than four times, the concentration of fumed alumina particles, if any, in the ink-receiving intermediate layer.

In another embodiment of the invention, wherein the intermediate layer comprises at least 50 percent by weight fumed silica particles, an uppermost layer comprising colloidal silica particles is advantageously paired with the intermediate layer comprising fumed silica particles. Typically, the colloidal particles useful in the uppermost layer are treated with a cationic modifier selected from the types disclosed above for use with kaolin particles.

With respect to the ink-receiving intermediate layer and the image-receiving upper layer, both being porous, they each contain interconnecting voids. The ink-receiving intermediate layer and the image-receiving upper layer will collectively be referred to as the "gloss-producing ink-receiving layers," since they contribute to the bulk of the gloss. As mentioned above, the voids in each of the gloss-producing ink-receiving layers provide a pathway for an ink to penetrate appreciably into the base layer, thus allowing the base layer to reduce the dry time. Suitably, the voids in the gloss-producing ink-receiving layer are open to (connect with) and advantageously (but not necessarily) have a void size similar to the voids in the base layer for optimal interlayer absorption.

In addition to the inorganic particles mentioned above, the ink-receiving intermediate layer and the image-receiving upper layer may independently contain organic particles such as poly(methyl methacrylate), polystyrene, poly(butyl acrylate), etc. as well as additional mixtures of inorganic particles that include titania, calcium carbonate, barium sulfate, or other inorganic particles. Advantageously, substantially all the particles in the gloss-producing ink-receiving layers have an average primary particle size of not more than 300 nm.

Suitably, the polymeric binders for the gloss-producing ink-receiving layers independently comprise, for example, a hydrophilic polymer such as poly(vinyl alcohol), polyvinyl acetate, polyvinyl pyrrolidone, gelatin, poly(2-ethyl-2-oxazoline), poly(2-methyl-2-oxazoline), poly(acrylamide), chitosan, poly(ethylene oxide), methyl cellulose, ethyl cellulose, hydroxyethyl cellulose, hydroxypropyl cellulose, etc. Other binders can also be used such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, and copolymers of vinylacetate and n-butylacrylate.

The particle-to-binder weight ratio of the particles and binder employed in the porous gloss-producing ink-receiving layer can range from less than 100:0 to greater than or equal to 60:40. Suitably, the particle to binder ratio is at least 80:20. Advantageously, the particle to binder ratio is at least 90:10. In general, a layer having a particle-to-binder ratio less than stated will usually not be sufficiently porous to provide good image quality. While it has been known in the art to coat a very thin uppermost layer from a coating composition containing no binder, particularly in the uppermost layer, a particle to binder ratio no more than 98:2 is typical. Advantageously, the particle to binder ratio is no more than 97:3. Layers with higher particle to binder ratios may be more susceptible to cracking or loss of layer-to-substrate adhesion. In a desirable embodiment of the invention, the volume ratio of the particles to the polymeric binder in the gloss-producing ink-receiving layer is from about 1:1 to about 15:1.

Other additives that optionally can be included in the gloss-producing ink-receiving layers include pH-modifiers like nitric acid, cross-linkers, rheology modifiers, surfactants, UV-absorbers, biocides, lubricants, dyes, dye-fixing agents or mordants, optical brighteners, and other conventionally known additives.

The inkjet recording element can be specially adapted for either pigmented inks or dye-based inks, or designed for both. In the case of pigment based inks, the image-receiving upper layer can function as a pigment-trapping layer. In the case of dye-based inks, both the upper and intermediate layers, or an upper portion thereof, may contain the image, depending on effectiveness of any mordants in the layers.

The term "pigment-trapping layer" is used herein to mean that, in use, typically at least about 75% by weight, or substantially all, of the pigment colorant in the inkjet ink composition used to print an image remains in the pigment-trapping layer.

A dye mordant can be employed in any of the ink-retaining layers, but usually at least the image-receiving upper layer and optionally also the intermediate layer. The mordant can be any material that is substantive to the inkjet dyes. The dye mordant removes dyes from dye-based ink received from the ink-retaining layer and fixes the dye within the one or more dye-trapping layers. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethylammonium)propyl methacrylate chloride; a copolymer of vinylpyrrolidinone and vinyl(N-methylimidazolium chloride; and hydroxyethylcellulose derivatized with 3-N,N,N-trimethylammonium)propyl chloride. In a desirable embodiment, the cationic mordant is a quaternary ammonium compound.

In order to be compatible with the mordant, both the binder and the polymer in the layer or layers in which it is contained should be either uncharged or the same charge as the mordant. Colloidal instability and unwanted aggregation could result if a polymer or the binder in the same layer had a charge opposite to that of the mordant.

In one embodiment, the porous upper image-receiving layer may independently comprise dye mordant in an amount of at least 2 percent, typically 10 percent, suitably 15 percent by weight of the layer. Typically, the mordant comprises no more than 40 percent of the layer by weight, and suitably no more than 25 percent by weight. The upper layer advantageously is the layer containing substantially the highest concentration and amount of mordant.

The support for the coated ink-retaining layers may be selected from plain papers, preferably raw (uncoated paper). Thus, resin-coated papers are to be avoided. The thickness of the support employed in the invention can be from about 12 to about 500 μm, typically from about 75 to about 300 μm.

If desired, in order to improve the adhesion of the base layer to the support, the surface of the support may be corona-discharge-treated prior to applying the base layer to the support.

Since the inkjet recording element may come in contact with other image recording articles or the drive or transport mechanisms of image-recording devices, additives such as surfactants, lubricants, and matte particles may be added to the inkjet recording element to the extent that they do not degrade the properties of interest.

The present inkjet recording element, or a sheet material that is divided into separate elements, may be made by various coating methods which may include, but are not limited to, wound wire rod coating, slot coating, slide hopper coating, gravure, and curtain coating. Some of these methods allow for simultaneous coatings of two or more layers, which is preferred from a manufacturing economic perspective.

The inkjet recording material is advantageously manufactured by a process comprising the steps of:

a) providing a water-absorbent support;

b) coating in one pass upon at least one surface of the support, by a pre-metering method, at least three coating compositions independently comprising inorganic particles, binder, and optionally surfactant to provide a base layer on the support, an intermediate layer upon the base layer, and an uppermost layer upon the intermediate layer; and then c) drying the coated layers.

If desired, the dried layers may then be subjected to calendering.

Suitably, the coating compositions are aqueous compositions. Typically, the inorganic particles of the base layer coating composition comprise at least 50 percent by weight of clay particles as described above for the composition of the dried base layer. Advantageously the clay particles are treated with a cationic modifier as described above to a degree that the treated particles demonstrate a positive Zeta potential. Typically the base layer coating composition comprises at least 30 percent solids, desirably at least 40 percent solids, advantageously at least 50 percent solids. If the coating composition is too low in solids, the production process, particularly the drying step, becomes inefficient.

Typically, the inorganic particles of the intermediate layer coating composition comprise the particles disclosed above in the description of the composition of the dried intermediate layer. Advantageously the inorganic particles of the intermediate layer coating composition demonstrate a positive Zeta potential. Examples of such suitable cationic particles include untreated or treated alumina or hydrated alumina particles and silica particles treated with a cationic modifier. Coating compositions for the intermediate layer comprising cationic particles are compatible with the coating composition for the base layer comprising cationic particles.

Typically, the inorganic particles of the uppermost layer coating composition comprise the particles disclosed above in the description of the composition of the dried uppermost layer. Advantageously the inorganic particles of the coating composition for the uppermost layer demonstrate a positive Zeta potential. Examples of such suitable cationic particles include untreated or treated alumina or hydrated alumina particles and silica particles treated with a cationic modifier. Coating compositions for the uppermost layer comprising cationic particles are compatible with the coating composition for the intermediate layer comprising cationic particles.

Typically the intermediate and uppermost layer coating compositions independently comprise at least 20 percent solids, desirably at least 25 percent solids, advantageously at least 30 percent solids.

In a desirable method, the three coating compositions of step (b) are simultaneously coated in a single station.

In an advantageous embodiment, the three layers are simultaneously coated by a pre-metering method. Advantageously, the layers are coated by the method of curtain coating.

Optional other layers, including subbing layers, overcoats, further intermediate layers between the base layer and the upper layer, etc. may be coated by conventional coating means onto a support material commonly used in this art. Preferably, the base layer and the intermediate layers are the only layers comprising more than 5 g/m$^2$ dry weight.

Alternative embodiments of the invention may provide reduced coalescence, bleed, smearing, and sensitivity to extremes of humidity, improved manufacturability, transport through a printer, image quality, dry time, color density, gloss, abrasion and scratch resistance, resistance to cracking, layer adhesion, water-fastness, image stability, resistance to image fade attributable to ambient gases or visible or UV light exposure, reduced gloss artifacts such as differential gloss and color gloss, and reduced curl during manufacturing, storage, printing, or drying.

Example 1

A first composition comprising clay (Hydraglos 90, Huber, 0.2 microns average Stokes equivalent particle diameter) in water at 60% solids by weight was prepared by dispersing for 30 minutes with a rotor stator mixer. In preparation of individual samples, a cationic surface modifier was added to water and after 5 minutes stirring, a portion of the clay dispersion was added to this mixture and stirred for 30 minutes. Finally, poly(vinyl alcohol) (CELVOL 325, Air Products and Chemicals, Inc.) was added and the composition was stirred for an additional 30 minutes. Surface modifier p-DADMAC is Aldrich very low molecular weight poly(diallyldimethylammonium chloride, Cat. No. 522376). SYLOJET A200 is dialuminum chloride pentahydroxide solution (Grace Davison, $Al_2(OH)_5Cl$). The relative amounts of materials are shown in Table 1.

TABLE 1

Base layer coating compositions

| | | Weight % | | |
|---|---|---|---|---|
| Sample | Cationic modifier | Cationic Modifier | Clay | PVA Binder |
| CP-1 | p-DADMAC | 1.00 | 94.24 | 4.76 |
| CP-2 | p-DADMAC | 2.00 | 93.29 | 4.71 |
| CS-1 | SYLOJET A200 | 1.00 | 94.24 | 4.76 |
| CS-2 | SYLOJET A200 | 2.00 | 93.29 | 4.71 |

A second composition was prepared by combining hydrated alumina (CATAPAL 200, Sasol Corp., primary particle size 40 nm), poly(vinyl alcohol) (GOHSENOL GH-23, Nippon Gohsei Co.), CARTABOND GH (Clariant Corp.) and glyoxal crosslinker and boric acid in a ratio of 95.38/4.25/0.25/0.13 to provide an aqueous coating formulation of 33% solids by weight.

A third composition was prepared by combining hydrated alumina (DISPAL 14N4-80, Condea Vista Co., dispersed particle size 120 nm), fumed alumina (CAB-O-SPERSE PG003, Cabot Corp., mean aggregate diameter 150 nm by photon correlation spectroscopy), poly(vinyl alcohol) (GOHSENOL GH-23, Nippon Gohsei Co.), cationic mordant (mordant 2 in U.S. Pat. No. 6,045,917), CARTABOND GH glyoxal (Clariant Corp.), and boric acid in a ratio of 36.4:41.58:5.23:15.72:0.25:0.13 to give an aqueous coating formulation of 21% solids by weight. Surfactants ZONYL FSN (DuPont Co.) and OLIN 10G (Olin Corp.) were added in small amounts as coating aids.

The charge equivalent weight of cationic modifier may be calculated by dividing the molecular weight of the modifier by the number of cationic moieties per molecule and by the formal charge. For a molecular compound, the charge-equivalent weight is equal to the molecular weight divided by the formal charge, for example in dialuminum chloride pentahydroxide the charge-equivalent weight is 174 g/mole. For a homopolymer, the charge-equivalent weight is equal to the molecular weight of the repeat unit divided by the formal charge, for example in p-DADMAC, the charge equivalent weight is 162 g/mole. The charge equivalent weight was then used to calculate the ratio of charge equivalents to the weight of clay in a composition.

The viscosities of the various samples of the first composition were measured using a Brookfield apparatus with a #18 spindle at 0.5 rpm. Coatings were prepared comprising the first, second, and third compositions in order onto a support consisting of a low-wet-expansion, mixed-hardwood paper base of 180 g/m$^2$ basis weight by a simultaneous slide-hopper, bead-coating process and dried. The coating quality was visually evaluated and the observations recorded in Table 2.

TABLE 2

| Evaluation results | | | |
|---|---|---|---|
| Sample | Ratio of modifier to clay (mmole eq charge/g clay) | Viscosity of base layer composition (m · Pa · s) | Quality of three-layer coating |
| CP-1 (comparison) | 0.066 | 6000+ | Base layer composition too viscous to coat |
| CP-2 (Invention) | 0.133 | 41.5 | Satisfactory |
| CS-1 (comparison) | 0.061 | 6000+ | Base layer composition too viscous to coat |
| CS-2 (Invention) | 0.123 | 28 | Satisfactory |

The results shown in Table 2 demonstrate that an insufficient amount of cationic modifier causes a dramatic increase in viscosity of the anionic clay dispersion, and thus the dispersion becomes uncoatable. A possible explanation for the observed behavior is that either a mixture of cationically modified and unmodified anionic particles and/or nearly neutral surface charge on partially modified particles results in dispersion instability. When the charge-equivalent amount of modifier is greater than about 0.1 millimoles of modifier per gram of dry clay, the viscosity of the composition is suitable for coating. The results further demonstrate that simultaneous multilayer coating of compositions comprising clay and alumina are possible if the clay dispersion is pre-treated with a cationic surface modifier in sufficient quantity.

Example 2

Base layer coating compositions were prepared as in the first composition of Example 1 except that silica gel (IJ-624, Crosfield Ltd.) replaced about 20% of the clay. The procedure of Example 1 was followed except that the silica gel was added after the 30 minute mixing period following addition of the cationic modifier in Example 1, and an additional 15 minutes of mixing was incorporated after the addition of silica gel. Table 3 summarizes the components of the base layer compositions.

TABLE 3

| Base layer compositions | | | | | | |
|---|---|---|---|---|---|---|
| | | Weight % | | | | Ratio of Charge equivalent of modifier (mmoles eq) |
| | Modifier | Clay | Modifier | Silica | PVA binder | to Clay (grams) |
| CC6 (comp) | p-DADMAC | 75.41 | 1.03 | 18.85 | 4.71 | 0.082 |
| CC7 | p-DADMAC | 74.64 | 2.05 | 18.65 | 4.66 | 0.166 |
| CC8 | p-DADMAC | 73.88 | 3.04 | 18.46 | 4.62 | 0.251 |
| CC9 | p-DADMAC | 73.14 | 4.01 | 18.28 | 4.57 | 0.338 |
| CC10 | p-DADMAC | 72.41 | 4.97 | 18.1 | 4.52 | 0.427 |
| CC11 (comp) | SYLOJET A200 | 75.41 | 1.03 | 18.85 | 4.71 | 0.076 |
| CC12 | SYLOJET A200 | 74.64 | 2.05 | 18.65 | 4.66 | 0.154 |
| CC13 | SYLOJET A200 | 73.88 | 3.04 | 18.46 | 4.62 | 0.233 |
| CC14 | SYLOJET A200 | 73.14 | 4.01 | 18.28 | 4.57 | 0.313 |
| CC15 | SYLOJET A200 | 72.41 | 4.97 | 18.1 | 4.52 | 0.396 |
| CC16 (comp) | None | 76.2 | 0 | 19.04 | 4.76 | 0 |

A three-layer coating was prepared from each of the base layer compositions CC6-CC16 in turn by simultaneous slide hopper bead coating of the base layer, mid layer (second), and upper layer (third) compositions as in Example 1 on a paper support followed by air drying. The base layer compositions were coated at 26.98 cc/m$^2$ wet lay down to give a fixed dry weight of clay, silica gel, and PVA of (6.52, 1.63, 0.41) g/m$^2$, respectively.

The coating made with CC16 base layer composition comprising unmodified clay particles was of poor quality. Coating quality of the compositions CC7 through CC10 and CC12 through CC15, treated with at least 0.1 mmole of p-DADMAC or SYLOJET A200, provided good quality coatings, but the compositions CC6 and CC11, comprising lesser amounts of modifier, coated poorly. The observations of coating quality are summarized in Table 4.

The zeta potentials of the compositions CC6 to CC16 were measured according to the standard procedure referenced above in the detailed description of the invention and are summarized in Table 4.

TABLE 4

| Evaluation results | | | | | | | |
|---|---|---|---|---|---|---|---|
| | | Cationic modifier | | | Base layer composition | | |
| Base Layer | Type | Type | Wt % | mmoles eq per g clay | Zeta potential (mV) | Viscosity (m · Pa · s) | Quality of three-layer coating |
| CC6 | Comp | p-DADMAC | 1 | 0.082 | 22 | >6000 | No coating |
| CC7 | Inv | p-DADMAC | 2 | 0.166 | 24 | 90 | Satisfactory |
| CC8 | Inv | p-DADMAC | 3 | 0.251 | 34 | 49.2 | Satisfactory |
| CC9 | Inv | p-DADMAC | 4 | 0.338 | 50 | 56.3 | Satisfactory |
| CC10 | Inv | p-DADMAC | 5 | 0.427 | 53 | 69.6 | Satisfactory |
| CC11 | Comp | SYLOJET A200 | 1 | 0.076 | 3 | >6000 | Streaks |
| CC12 | Inv | SYLOJET A200 | 2 | 0.154 | 18 | 70 | Satisfactory |
| CC13 | Inv | SYLOJET A200 | 3 | 0.233 | 20 | 58 | Satisfactory |
| CC14 | Inv | SYLOJET A200 | 4 | 0.313 | 20 | 63.8 | Satisfactory |
| CC15 | Inv | SYLOJET A200 | 5 | 0.396 | 29 | 58.2 | Satisfactory |
| CC16 | Comp | None | 0 | 0 | −29 | 49.4 | Streaks |

The composition CC16 containing untreated clay, silica gel (20% by weight), and PVA had a large zeta potential that was negative in sign. In samples CC6-CC-15, treatment with p-DADMAC or with SYLOJET A200 reversed the surface charge and raised the zeta potential above +15 mv, except for the lowest level of SYLOJET A200. The positive zeta potential is evidence that the surface of the particles was cationically modified by the treatment.

Example 3

A comparative inkjet receiver 3A (see Table 5) was prepared in a two-step coating process according to the method of US Patent Publication No. 2007/0202279 with the following modifications. A base layer composition consisting of precipitated calcium carbonate, silica gel, poly(vinyl alcohol), and latex in a ratio of 65.34/21.30/1.80/11.56 was coated at a dry weight of 32.3 g/m$^2$ over a paper support and dried. A coating composition was prepared for the uppermost layer consisting of a fumed alumina, a boehmite, poly(vinyl alcohol), a mordant, hardener, and surfactants at the ratio of 41.31/36.16/5.20/15.62/0.37/1.34. A coating composition was prepared for an intermediate layer consisting of a boehmite, poly(vinyl alcohol), and hardener at the ratio of 95.38/4.25/0.37. The uppermost and intermediate layers were simultaneously coated over the dried base layer coating at dry weights of 2.15 and 37 g/m$^2$, respectively. The total weight of the receiver 3A was 71.45 g/m$^2$.

An inkjet receiver 3B (see Table 5) was prepared according to the present invention with the following coating weights: (1) an uppermost layer consisting of a fumed alumina, a boehmite, poly(vinyl alcohol), a mordant, hardener, and surfactants at the ratio of 41.31/36.16/5.20/15.62/0.37/1.34 at a dry lay down of 2.15 g/m$^2$; (2) an intermediate layer consisting of boehmite, poly(vinyl alcohol), and hardener at the ratio of 95.38/4.25/0.37 at a dry lay down of 32 g/m$^2$; and (3) a base layer consisting of a kaolin clay treated with dialuminum chloride pentahydroxide, silica gel, and poly(vinyl alcohol) at a ratio of 73.06/4.12/18.26/4.56 at a dry lay down of 10 g/m$^2$. The total dry weight of the inkjet receiver 3B was 44.15 g/m$^2$.

Samples of each coating were calendered at equal temperature and pressure and the unprinted gloss was measured with a Gardner Gloss Meter. The gloss results are shown in Table 5.

TABLE 5

| Sample | 20 degree Gardner gloss | 60 degree Gardner gloss | 85 degree Gardner gloss |
|---|---|---|---|
| 3A (comparative) | 32 | 63.5 | 88.5 |
| 3B (invention) | 33.4 | 68.2 | 91.4 |

The lower-weight, simultaneous-coating inventive Sample 3B, provides improved gloss compared to the heavier-weight, sequential-coating comparative coating Sample 3A. Although the inventive example Sample 3B with significantly lower weight might be expected to provide less ink capacity, no coalescence was observed when the Samples 3A and 3B were printed with a KODAK EASYSHARE 5300 printer.

The Samples 3A and 3B were further evaluated by printing with an Epson 340 dye-based inkjet printer with color management disabled. The reflection density at Dmax was measured for primary colors CMY, secondary colors RGB, and black. The density measurements are shown in Table 6.

TABLE 6

| | Average Density | | | |
|---|---|---|---|---|
| Sample | CMY | RGB | K | CMYRGBK |
| 3A (comparative) | 1.78 | 1.61 | 1.94 | 1.77 |
| 3B (invention) | 1.91 | 1.76 | 2.19 | 1.95 |

The results shown in Table 6 demonstrate that a coating of the present invention provides improved density with dye-based ink compared to the comparative, heavier-weight coating comprising a calcium carbonate base layer.

This invention has been described in detail with particular reference to certain preferred embodiments thereof, but it will be understood that variations and modification can be effected within the spirit and scope of the invention. The entire contents of the patents and other publications referred to in this specification are incorporated herein by reference.

| PARTS LIST | |
|---|---|
| 10 | inkjet printer |
| 12 | image data source |
| 18 | ink tanks |
| 20 | recording media supply |
| 22 | printed media collection |
| 30 | printhead |
| 40 | protective cover |
| 100 | carriage |
| 215 | optical sensor |
| 302 | media direction |
| 303 | print region |
| 304 | media direction |
| 312 | feed roller(s) |
| 313 | forward direction |
| 320 | pickup roller(s) |
| 322 | turn roller(s) |
| 323 | idler roller(s) |
| 324 | discharge roller(s) |
| 325 | star wheel(s) |
| 350 | media transport path |
| 360 | media supply tray |
| 371 | media sheet |
| 375 | further optical sensor |
| 380 | media output tray |
| 390 | printed media sheet |

The invention claimed is:

1. An inkjet printing system, comprising:

a) an inkjet printer;

b) an ink composition; and c) an inkjet recording media comprising a support, and coated on the support in order from the support, a porous base layer, a porous intermediate layer, and a porous uppermost layer, wherein:

1) the porous base layer comprises a binder and clay particles treated with a cationic surface modifier to provide a zeta potential with a positive sign, the clay having a median particle diameter less than 1.0 micron;

2) the porous intermediate layer and the porous uppermost layer independently comprise particles of a semi-metallic or metallic oxide, either having or treated to have a zeta potential with a positive sign, the particles having median secondary particle diameter less than 500 nm; and 3) the ratio of the millimole equivalents of cationic modifier to grams of clay particles in the base layer is greater than 0.1.

2. The system of claim 1 wherein the metallic oxide is independently selected from fumed alumina, hydrated alumina and mixtures thereof, and the semi-metallic oxide is selected from cationically modified fumed silica, cationically modified colloidal silica, and mixtures thereof.

3. The system of claim 1, wherein the support is absorbent paper.

4. The system of claim 1, wherein the porous base layer comprises a combination of cationically modified clay and silica gel.

5. The system of claim 1, wherein the porous base layer binder comprises a PVA binder.

6. The system of claim 1, wherein the cationic surface modifier is dialuminum chloride pentahydroxide.

7. The system of claim 1, wherein the cationic surface modifier is a cationic polymer containing a quaternary amine.

8. The system of claim 1, wherein the cationic surface modifier is an aminosilane.

9. The system of claim 1, wherein the uppermost layer comprises a PVA binder.

10. The system of claim 1, wherein the porous uppermost layer comprises a mixture of filmed alumina and colloidal alumina (boehmite).

11. The system of claim 1, wherein the clay of the base layer comprises kaolin.

12. An inkjet recording media comprising a support, and coated on said support in order from the support, a porous base layer, a porous intermediate layer, and a porous uppermost layer, wherein:

1) the porous base layer comprises a binder and clay particles treated to provide a zeta potential with a positive sign, the clay having a median particle diameter less than 1.0 micron;

2) the porous intermediate layer and the porous uppermost layer independently comprise particles of a semi-metallic or metallic oxide, either having or treated to have a zeta potential with a positive sign, the particles having a median secondary particle diameter less than 500 nm; and 3) the ratio of the millimole equivalents of cationic modifier to grams of particles in the base layer is greater than 0.1.

13. The media of claim 12, wherein the base layer comprises kaolin.

14. The media of claim 12, wherein the metallic oxide is independently selected from fumed alumina, hydrated alumina, and mixtures thereof, and the semi-metallic oxide is selected from cationically modified filmed silica, cationically modified colloidal silica, and mixtures thereof.

15. A method of manufacturing an inkjet recording media comprising the steps of:

a. providing an absorbent support;

b. providing a first aqueous coating composition comprising clay particles, a cationic surface modifier to provide a provide a zeta potential with a positive sign, the clay particles having a median particle diameter less than 1.0 micron, and a binder, wherein the ratio of the millimole equivalents of cationic modifier to grams of particles is greater than 0.1;

c. providing a second and a third aqueous coating composition independently comprising a binder and fumed alumina, hydrated alumina, cationically modified fumed silica or cationically modified colloidal silica, or a combination thereof;

d. coating the first, the second, and the third coating compositions in that order in one coating pass on the support; and e. drying the coating.

16. The method of claim 15, comprising the subsequent step of calendering the coating.

17. The method of claim 15, wherein at least two coating compositions are coated simultaneously.

18. The method of claim 15, wherein the clay particles are modified with p-DADMAC or dialuminum chloride pentahydroxide in step b.

19. The method of claim 15, wherein the first coating composition also comprises silica gel.

20. The method of claim 13, wherein the recording media provides a 60-degree Gardner gloss of at least 15.

* * * * *